US007322923B2

(12) United States Patent
Harris et al.

(10) Patent No.: US 7,322,923 B2
(45) Date of Patent: Jan. 29, 2008

(54) DUNNAGE SHEET REMOVAL APPARATUS

(75) Inventors: Richard D. Harris, Indianapolis, IN (US); Achie B. Russell, Connersville, IN (US)

(73) Assignee: Systec Corporation, Indianapolis, IN (US)

( * ) Notice: Subject to any disclaimer, the term of this patent is extended or adjusted under 35 U.S.C. 154(b) by 46 days.

(21) Appl. No.: 11/155,983

(22) Filed: Jun. 17, 2005

(65) Prior Publication Data

US 2006/0287180 A1 Dec. 21, 2006

(51) Int. Cl.
*B31B 49/00* (2006.01)

(52) U.S. Cl. ..... 493/342; 271/18; 414/797.7; 493/374

(58) Field of Classification Search ..... 493/342, 493/967, 374; 271/273, 18, 109, 285, 280, 271/37, 113; 414/797.7, 797.4, 795.4, 929
See application file for complete search history.

(56) References Cited

U.S. PATENT DOCUMENTS

| | | | | | |
|---|---|---|---|---|---|
| 2,897,772 | A | * | 8/1959 | Hunter | 99/352 |
| 3,056,515 | A | * | 10/1962 | Anderson | 414/796.8 |
| 3,682,338 | A | | 8/1972 | Von Gal, Jr. et al. | |
| 4,552,499 | A | * | 11/1985 | Foust et al. | 414/797.4 |
| 4,624,620 | A | | 11/1986 | Farmer et al. | |
| 4,655,672 | A | * | 4/1987 | Sinclair et al. | 414/661 |
| 4,678,178 | A | * | 7/1987 | Akiyama et al. | 271/242 |
| 4,753,564 | A | | 6/1988 | Pearce et al. | |
| 4,850,580 | A | * | 7/1989 | Denzin et al. | 271/2 |
| 4,889,463 | A | | 12/1989 | Frost et al. | |
| 4,907,942 | A | * | 3/1990 | Pfeil | 414/798 |
| 4,988,264 | A | | 1/1991 | Winski | |
| 5,102,282 | A | * | 4/1992 | Maddox | 414/404 |
| 5,205,704 | A | | 4/1993 | Frost et al. | |
| 5,330,311 | A | | 7/1994 | Cawley et al. | |
| 5,351,945 | A | * | 10/1994 | Asakawa et al. | 271/118 |
| 5,423,657 | A | * | 6/1995 | Frost et al. | 414/796.8 |
| 5,984,623 | A | | 11/1999 | Smith et al. | |
| 6,595,740 | B1 | | 7/2003 | Drake et al. | |
| 6,929,257 | B2 | * | 8/2005 | Richardson et al. | 271/21 |

FOREIGN PATENT DOCUMENTS

| | | | |
|---|---|---|---|
| JP | 62-21629 A | * | 1/1987 |
| JP | 63-57452 A | * | 3/1988 |
| JP | 6-191657 A | * | 7/1994 |

* cited by examiner

*Primary Examiner*—Stephen F. Gerrity
(74) *Attorney, Agent, or Firm*—Maginot, Moore & Beck

(57) ABSTRACT

A dunnage removal apparatus is situated adjacent a load conveyor and more particularly at a transfer device that moves a unitized load from the load conveyor to a pre-feeder. The dunnage removal apparatus includes a guide chute that funnels a loose flap of the dunnage sheet toward a sheet stripper mechanism. The mechanism includes a motor driven drive roller and a pair of pinch rollers that pinch the flap and pull the dunnage sheet from beneath the load. The pinch rollers are supported for movement relative to the drive roller to accept dunnage sheet(s) of variable thicknesses. A backstop plate is provided that moves with the pinch rollers. The load bears against the backstop plate as the dunnage sheet(s) is removed.

10 Claims, 4 Drawing Sheets

DUNNAGE SHEET REMOVAL APPARATUS

BACKGROUND OF THE INVENTION

The present invention relates to systems for the conveyance of unitized loads, such as transfer conveyors. More particularly, the invention pertains to an apparatus for removing a dunnage sheet from beneath a unitized load.

Many products are shipped using waste or dunnage material to protect stacked product. For instance, as shown in FIG. 1, dunnage material D protects a load L that is contained by an array of straps S. The load may be, for instance, multiple stacks of sheet material, such as corrugated sheet or paperboard blanks used in making boxes. The corrugated sheets are shipped flat in a stack about 72 inches high. The strap S is typically a plastic band that is tightened and clamped about the load stack. When it is desired to remove the load L from the waste sheet the straps S are typically manually cut and removed as the load travels along a load conveyor (FIG. 3).

When the load L is sheet material, such as the corrugated sheet mentioned above, dunnage or waste sheets D are added to the top and bottom of the load stack. The dunnage sheets D are provided to protect the surface and edges of the uppermost and lowermost sheets of the load stack. The dunnage sheets are therefore wider than the load so that the sides of the dunnage sheets D may be folded over the edge of the load. In a typical load of sheet material, multiple stacks are supported on one common dunnage array. In this case, the dunnage sheets D are sized to cover every stack and the straps S are sized and arranged to firmly hold all the stacks together.

When a unitized load of sheet stock is received, the unit is dropped on a load conveyor (FIG. 3). As the unitized load progresses along the conveyor, the straps S are cut and removed. The top dunnage sheet D is also removed so that the load L is free and available to be fed to a pre-feeder, as shown in FIG. 3. In certain systems, when the load L is prepared, a transfer device moves the load off the load conveyor and onto a transfer conveyor that leads to the sheet pre-feeder. At the pre-feeder, various operations are performed on the load, depending upon the nature of the pre-feeder and downstream processing stations. In some devices, the multiple load stacks are converted to a single stack, the stack(s) is inverted, smaller stacks are removed, etc.

The lower dunnage sheet poses a problem, especially for multiple stack loads. When the straps S are removed, the flaps F of the bottom dunnage sheet D tend to fall away from the load L, as shown in FIG. 2. Unless the dunnage sheet is removed prior to reaching the pre-feeder, the sheet may foul the operation of the pre-feeder. In most cases, the load L is too heavy for manual removal of the bottom dunnage sheet from underneath the load. Thus, an apparatus is required to mechanically remove the dunnage sheet without disturbing the multiple stack load and without unduly disrupting the process flow from the load conveyor to the pre-feeder. In one approach, a reverse running gum belt is situated at the transfer device (FIG. 3). A gate is lowered to hold the load L while the reverse running belt spins to slip the dunnage or waste sheet out from under the load. This approach requires essentially stopping the load while the retention gate is lowered and the reverse running belt operated to strip the dunnage sheet. Another problem is that this system typically only removes the lowermost dunnage sheet, so any additional dunnage sheets would remain undisturbed with the load. In another approach, the leading edge of the dunnage or slip sheet projects ahead of the load and is engaged by a mechanism that pulls the slip sheet away from the load as the mechanism is moved out of the path of the load.

What is needed is a dunnage sheet removal apparatus that may be easily integrated into an existing conveyor system and that performs its function without any significant disruption of the process flow from the load conveyor to the pre-feeder. There is a further need for a dunnage sheet removal apparatus that is capable of removing virtually any type and any number of waste sheets.

SUMMARY OF THE INVENTION

In view of these needs, the present invention provides a dunnage sheet removal apparatus that initially receives the side flap of the dunnage sheet and grasps that flap to pull the waste sheet out from under the load, all without substantially disturbing the process flow of the unitized load.

An apparatus is provided for removing a dunnage sheet from a unitized load in which a flap of the dunnage sheet extends beyond a side of the unitized load. In one embodiment, the apparatus comprises a guide chute having a mouth sized to receive the flap as the unitized load moves toward the guide chute. The guide chute is configured to funnel the flap to a dunnage slot. The apparatus further comprises a sheet stripper mechanism arranged to receive the flap as it passes through the dunnage slot. The sheet stripper mechanism is operable to pull the flap away from the unitized load.

In one embodiment, the sheet stripper mechanism includes a drive roller, a motor coupled to rotate the drive roller, and at least one pinch roller arranged parallel to the drive roller to pinch the flap therebetween. Preferably, two pinch rollers are provided that are spaced apart above the drive roller. The apparatus may further comprise a support frame with the drive roller rotatably supported on the support frame, and a pinch roller support assembly with the pinch roller(s) rotatably supported thereon. The pinch roller support assembly is supported on the support frame so that the pinch roller is movable to variable positions relative to the drive roller. These variable positions allow the sheet stripper mechanism to clamp onto flap(s)/dunnage sheet(s) of different thicknesses without modification of the apparatus.

In one embodiment, the pinch roller support assembly is configured to move the pinch rollers to the clamping position under influence of the dunnage sheet flaps. In a preferred embodiment, the pinch roller support assembly includes a power element mounted on the support frame and operable to move the pinch roller to a positioning in which it clamps the dunnage sheet against the drive roller. This power element may be an air spring or a pneumatic cylinder that is operated in response to the dunnage sheet flap being positioned fully within the removal apparatus. As the flap is funneled into the apparatus, the cylinder holds the pinch rollers offset from the drive roller. Once the flap is fully inserted, the cylinder is operable for the pinch rollers to drop into contact with the flap. In a preferred embodiment, the pinch roller support assembly includes resilient upper bushing mounts that push the pinch rollers down into contact with the flap and drive roller.

In a further aspect of the invention, the means for supporting supports a backstop plate for movement with the pinch rollers relative to the drive roller. The backstop plate is contacted by the unitized load as the dunnage sheet is stripped from beneath the load. The backstop plate thus prevents a sheet load from being pulled into the sheet stripper mechanism.

In a further aspect of the invention, a method is provided for removing a dunnage sheet from a unitized load in which a flap of the dunnage sheet extends beyond a side of the unitized load. In one embodiment, the method comprises the steps of guiding the flap into a sheet stripper mechanism, engaging the flap by the sheet stripper mechanism, and operating the sheet stripper mechanism to pull the flap to thereby strip the dunnage sheet from beneath the unitized load. In certain embodiments, the step of guiding the flap includes conveying the unitized load along a conveyor toward the sheet stripper mechanism, and funneling the flap into the sheet stripper mechanism as the load is conveyed toward the mechanism.

In other embodiments, the step of engaging the flap includes pinching the flap between a powered drive roller and at least one pinch roller, and the step of operating the sheet stripper mechanism includes rotating the drive roller to pull the flap to thereby strip the dunnage sheet from beneath the unitized load. The method may also include the step of providing a backstop for the unitized load during the step of operating the sheet stripper mechanism to prevent movement of the load toward the mechanism.

One object of the invention is to provide an apparatus that may be combined with an existing conveyor system to remove the waste or dunnage sheets from beneath a unitized load. One benefit of the present invention is that it is capable of removing dunnage sheets of any number and type. Another benefit is that the apparatus of the present invention can remove the dunnage sheets with almost no interruption in the flow of the load to the next downstream processing station.

DESCRIPTION OF THE PREFERRED EMBODIMENTS

Figure 1:
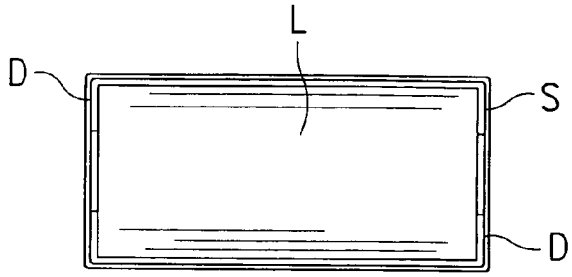
FIG. 1 is an end view of a unitized load that includes waste or dunnage sheets at the top and bottom of the load.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
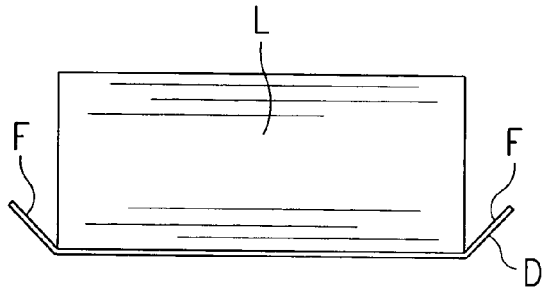
FIG. 2 is an end view of the unitized load shown in FIG. 1 with the straps and upper dunnage sheet removed.
Figure 3:
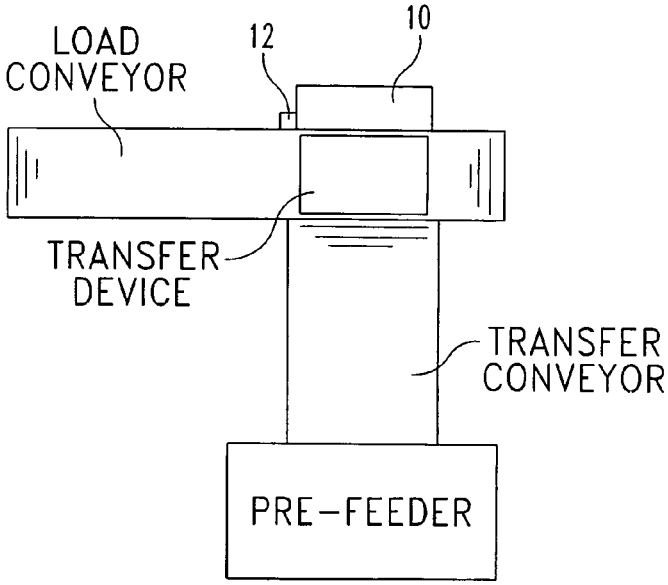
FIG. 3 is a top view of a conveyor system integrated with the sheet removal apparatus of the present invention.

The present invention contemplates an apparatus 10 that can be integrated into an existing conveyor system, such as the arrangement shown in FIG. 3. In accordance with the preferred embodiment, the apparatus 10 is situated adjacent a transfer device that is used to move the unitized load (FIG. 1) from the load conveyor to the transfer conveyor. It is understood that prior to reaching the transfer device, the straps S and upper dunnage sheet have been removed from the unitized load. Thus, upon arriving at the transfer device the load L and dunnage sheet D appear as shown in FIG. 2. More specifically, the flaps F of the dunnage sheet D are displaced from the side of the load L. When the straps S (FIG. 1) are removed, the flaps F will fall naturally to the position shown in the figure.

Figure 4:
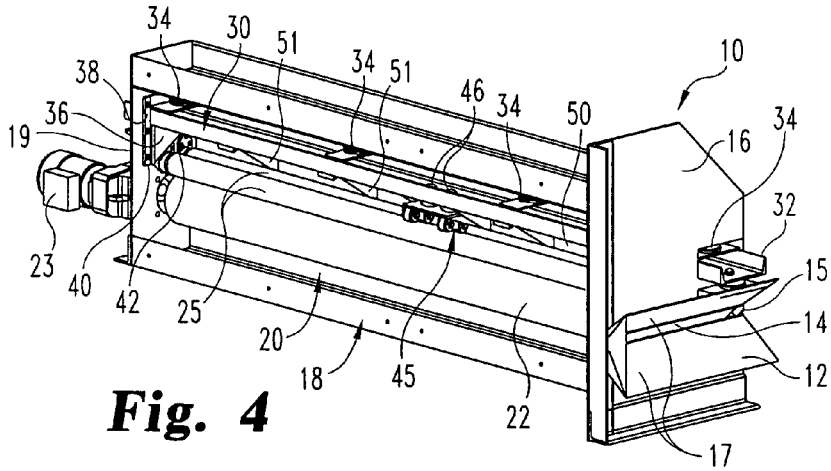
FIG. 4 is a rear perspective view of the sheet removal apparatus in accordance with one embodiment of the present invention.

The sheet removal apparatus 10 is shown in detail in FIGS. 4-10. In general, as seen in FIG. 4, the apparatus 10 includes a guide chute 12 that is arranged to open toward the oncoming unitized load (FIG. 3). The chute 12 essentially funnels the flap F at one side of the dunnage sheet D into a dunnage slot 14. The slot 14 has an open mouth 15 facing the load conveyor so that the dunnage sheet D can slide into the slot 14 as the load travels along the conveyor. The mouth of the chute 12 is defined by the angled walls 17 projecting from the side wall 16. The width of the mouth of the chute is preferably slightly greater than twice the extent of the flap F. The leading edge of the flap F will thus be guaranteed to contact one of the chute walls 17 as the load moves toward the transfer device and the sheet removal apparatus 10. As the load moves closer, the angled walls direct the leading edge of the flap F into the slot 14.

Figure 6:
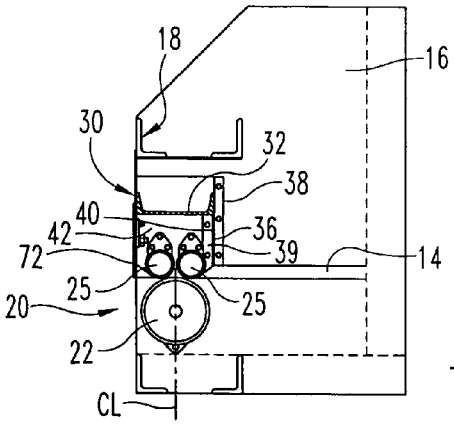
FIG. 6 is a side partial cross-sectional view of the sheet removal apparatus shown in FIGS. 5 and 7, taken along line 6-6 as viewed in the direction of the arrows.

The apparatus 10 includes a primary frame 18 that supports the side wall 16 as well as a sheet stripper mechanism 20 that is operable to grab the flap F of the dunnage sheet and pull the flap to remove the sheet from underneath the load L. The sheet stripper mechanism includes a drive roller 22 that is rotated by a motor 23 supported on a side wall 19 of the frame 18. The drive roller 22 is rotatably supported between the side walls 16 and 19 and is aligned to rotate about an axis parallel to the path of the load, dunnage sheet D and flap F. The roller is arranged so that the upper extent of the roller is generally aligned with the lower edge of the dunnage slot 14, as best shown in FIG. 6.

A pair of pinch rollers 25 are rotatably supported directly above the drive roller 22. The rollers 25 are separated from each other but are arranged to be in contact with the drive roller 22 flanking the vertical centerline CL of the roller. Thus, as shown in FIG. 6, the point of initial contact between the pinch rollers 25 and the drive roller 22 is slightly below the lower edge of the dunnage slot 14. The pinch rollers are arranged to pinch the dunnage sheet flap between the pinch rollers and the drive roller.

Figure 5:
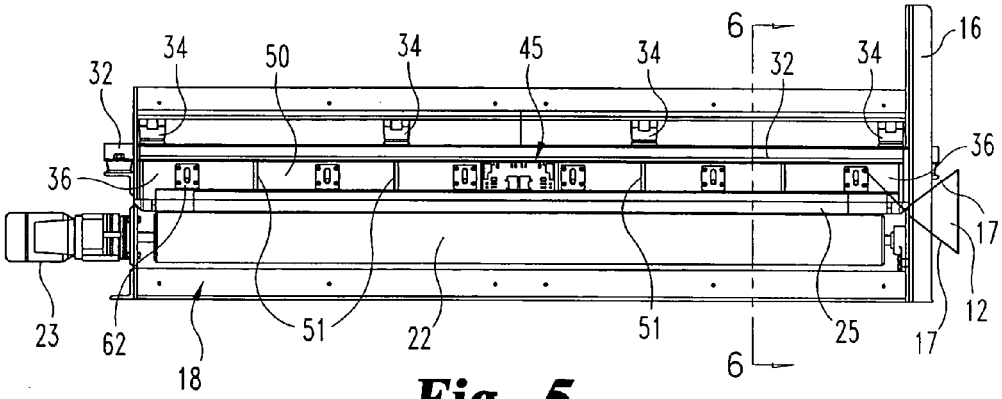
FIG. 5 is a rear elevational view of the sheet removal apparatus shown in FIG. 4.
Figure 7:
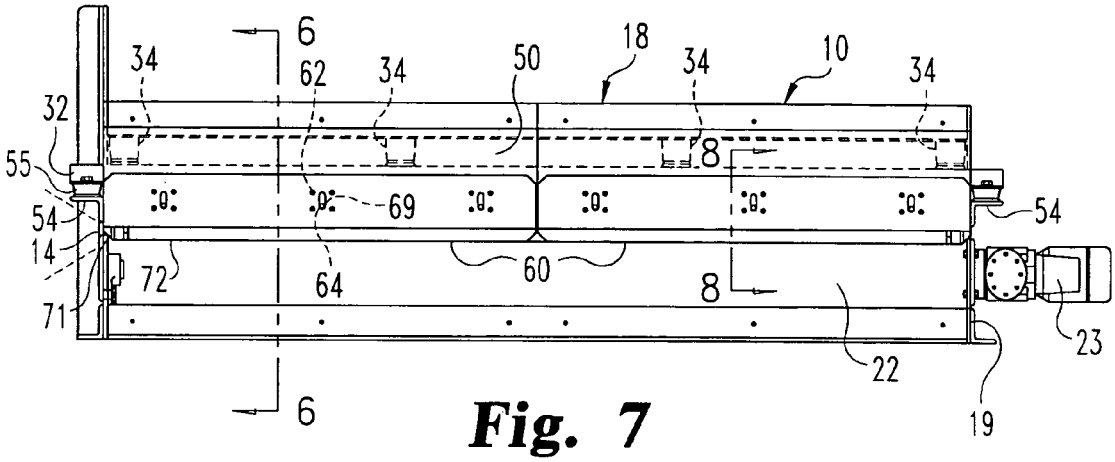
FIG. 7 is a front elevational view of the sheet removal apparatus shown in FIGS. 4-6.
Figure 8:
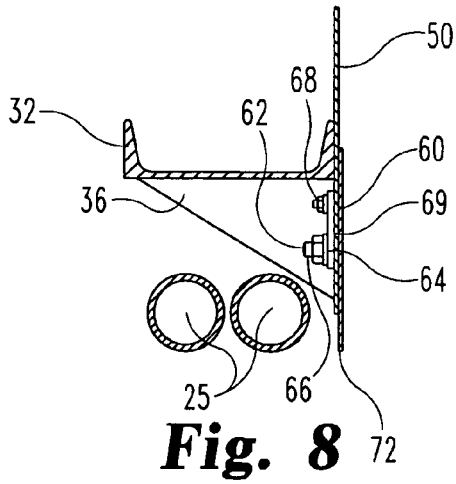
FIG. 8 is an enlarged cross-sectional view take along line 8-8 in FIG. 7 as viewed in the direction of the arrows.
Figure 9:
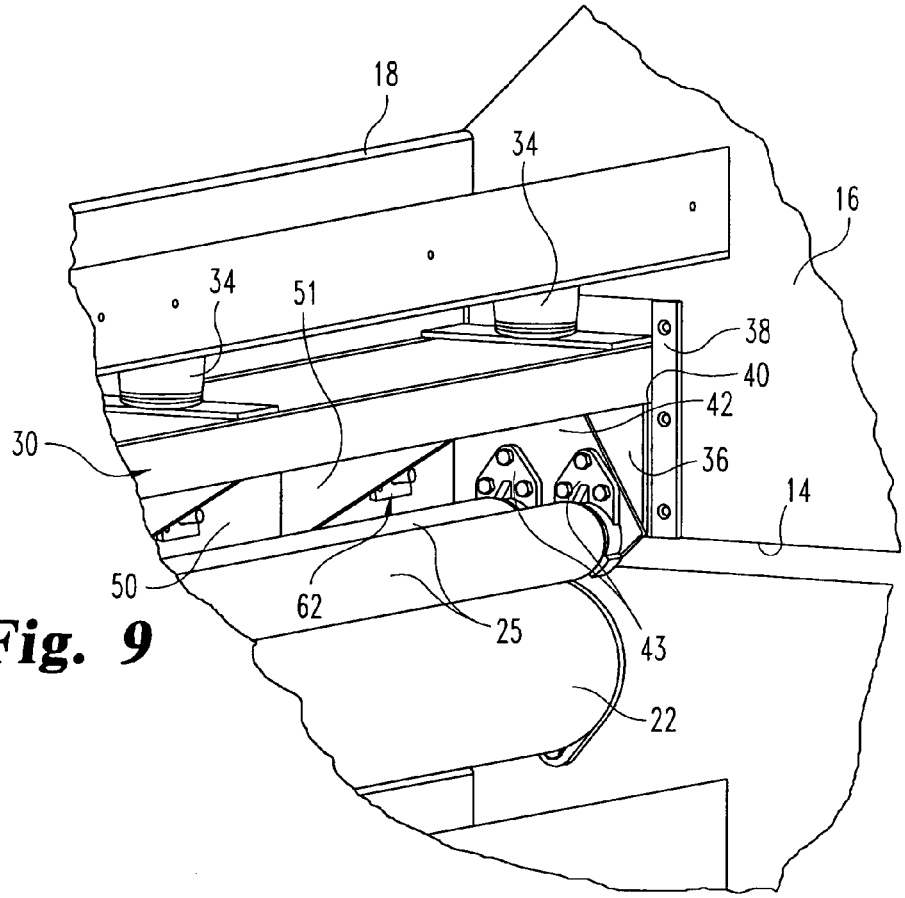
FIG. 9 is an enlarged perspective view of the sheet removal apparatus showing the dunnage slot and details of the pinch roller support assembly.
Figure 10:
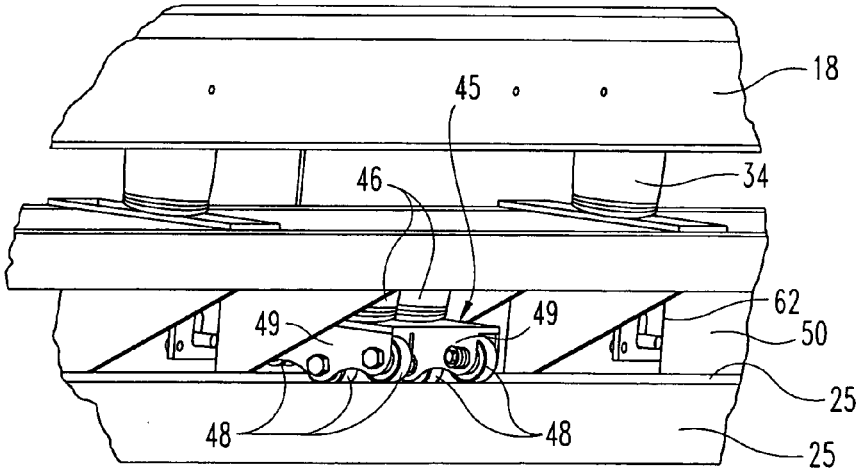
FIG. 10 is an enlarged perspective view of the pressure roller assembly of one embodiment of the sheet removal apparatus shown in FIG. 4-7.

While the pinch rollers 25 may contact with the drive roller, the pinch rollers are supported on the primary frame 18 so that the rollers can be displaced away from the surface of the drive roller as the dunnage sheet, or sheets, pass therebetween. Thus, the pinch rollers 25 are supported by a support assembly 30 that is connected to the primary frame 18. In one embodiment, the support assembly includes a channel beam 32 that is connected to the frame 18 by way of several power elements 34, as best shown in FIGS. 5 and 7. In the preferred embodiment, the power elements are air springs. The channel beam 32 projects beyond the sides of the frame 18 and is supported at these outboard positions by lower bushing mounts 55 carried by a corresponding mounting flange 54 fixed to the primary frame 18.

The air springs 34 and bushing mounts 55 support the channel beam 32 so that it can translate in the vertical direction relative to the drive roller 22. Thus, in one embodiment, as the dunnage sheet moves into contact with the drive roller 22, it slips between the drive roller and the pinch rollers 25, causing the pinch rollers to move upward, displacing the air springs 34. The air springs 34 are pressurized to maintain a substantially constant pressure between the drive roller and the pinch rollers to ensure that the rotation of the drive roller will impart a lateral force to the dunnage sheet. As shown in FIG. 4, the back side of the apparatus 10 (i.e., the side facing away from the conveyor) is open so that as the dunnage sheet is pulled by rotation of the drive roller the dunnage sheet is ejected onto the floor or into a waste sheet bin adjacent the apparatus.

The vertical movement of the pinch roller support assembly 30 is guided at opposite sides of the apparatus 10 by a corresponding guide flange 36 that is slidably positioned within a guide slot 40. The guide slot 40 is formed by two guide brackets 38, 39 mounted to the side walls of the primary frame 18, as most clearly shown in the enlarged view of FIG. 9. As shown in the figure, the guide flange 36 is configured to remain clear of the dunnage slot 14 and of the pinch rollers 25 so as not to interfere with the passage of the dunnage sheet(s) between the drive and pinch rollers. The guide flanges 36 are fixed to corresponding side support plates 42 that carry bearing mounts 43 that rotatably support the two pinch rollers 25.

To provide intermediate support for the pinch rollers 25, the apparatus 10 further includes a pressure roller assembly 45 situated generally at the middle of the length of the rollers. The pressure roller assembly 45 is carried on the channel beam 32 by a pair of bushing mounts 46 to permit a limited amount of vertical play. The assembly 45 includes two sets of three pressure rollers 48, with one of the rollers in each set situated between the two pinch rollers 25, as shown in the enlarged view of FIG. 10.

The pinch roller support assembly 30 further includes a front plate 50 that is fastened to the channel beam 32. The front plate 50 is arranged to face the load L as is moves next to the sheet removal apparatus 10. Stiffening ribs 51 are provided between the channel beam 32 and the plate 50 to add strength to the support assembly. More particularly, the front plate 50 is arranged to block movement of the load L as the dunnage sheet D is stripped from beneath the load by the rollers 22, 25. Thus, the ribs 51 add stiffness to the front plate so that the plate does not bend or buckle under pressure from the load.

The lower edge of the front plate 50 preferably terminates above the upper edge of the dunnage slot 14 so that the plate does not interfere with the dunnage sheet. However, in order to ensure that a load sheet cannot move between the rollers, a backstop plate 60 is adjustably mounted to the front plate 50 by an adjustable mounting arrangement 62. As shown in the detail view of FIG. 8, the mounting arrangement 62 includes a cap screw 64 projecting from the backstop plate 60. The cap screw 62 extends through a slot 69 defined in a guide plate 68 mounted to the front plate 50. The front plate includes a corresponding slot (not shown) that aligns with the slot 69. A locking cap 66 mates with the end of the cap screw 64 to hold the backstop plate 60 to the front plate 50. The cap screw 64 is configured to slide within the slot 69 as the backstop plate 60 moves up and down in response to the passage of a dunnage sheet through the apparatus.

The backstop plate 60 includes a lower edge 72 (FIGS. 6-8) that is preferably situated slightly below the line of contact between the pinch rollers 25 and the drive roller 22 and is also slightly below the lower edge of the dunnage slot 14. The end of the backstop plate facing the incoming unitized load includes a beveled edge 71 that is first contacted by the dunnage sheet. As the dunnage sheet travels further into the removal apparatus 10, the dunnage sheet lifts the backstop plate 60 up, while the plate maintains constant contact with the dunnage sheet. The backstop plate thus prevents a sheet in the load stack from passing underneath the plate 60 and into contact with the rollers 22, 25.

In one embodiment, the pinch rollers 25 and their associated support assembly 30, and the backstop plate 60, may be configured to move with the dunnage sheet D as it is conveyed through the dunnage slot 14 and between the drive roller 22 and the front pinch roller 25. Once the dunnage sheet has traveled across the front face of the apparatus 10, the drive motor 23 is activated to cause the drive roller 22 to rotate. Rotation of the drive roller 22 pulls the flap F of the dunnage sheet, and ultimately the entire dunnage sheet D, from the unitized load. The backstop plate 60 holds the load stack while the dunnage sheet is stripped. Once the sheet has been removed, the drive motor 23 is deactivated and the transfer device is activated to move the load along the transfer conveyor. Alternatively, the transfer device can be activated in due course once the flap F is grasped by the drive and pinch rollers. In this way, the movement of the load L away from the apparatus 10 facilitates removal of the dunnage sheet from the load.

In the most preferred embodiment, the pinch roller support assembly is powered to be raised and lowered during operation of the sheet removal apparatus 10. Thus, in this preferred embodiment, the lower bushing mounts 55 are replaced with power components, such as air springs, that operate to push the channel beam 32 upward away from the drive roller 22, and preferably above the upper edge of the dunnage slot 14. With this embodiment, a gap is created between the drive roller 22 and the pinch rollers 25 so that the dunnage sheet D may pass freely between the rollers. Once the dunnage sheet has reached the opposite end of the apparatus 10, the power components at the bushing mounts 55 are controlled to lower the pinch rollers onto the drive roller and to correspondingly lower the backstop plate 60 into its sheet removal position. When the pressure is relieved in the air springs, the upper air springs 34 push the pinch roller support assembly 30 down into the sheet stripping position.

In the preferred embodiment, the power components are air springs that are connected to a separate air source (not shown). While air springs are preferred because of their simplicity and responsiveness, other power components may be considered, such as pneumatic cylinders and electric motors.

It can be seen with the above embodiments that the apparatus 10 can accommodate any type, thickness and number of dunnage sheet(s). The pressure maintained between the pinch rollers 25 and the drive roller 22 is sufficient to grasp and remove most types of dunnage sheets without difficulty.

Operation of the sheet removal apparatus 10 may be governed by sensors that sense when a unitized load is approaching, when the flap F of a dunnage sheet D has entered the chute 12 and/or when the dunnage sheet has traveled the length of the apparatus 10 so that the sheet is fully within the apparatus. In addition, a sensor may be used to detect when the dunnage sheet has been completely stripped from the unitized load. Optical sensors may be used for all of these functions and may be tied to a controller that controls the activation/de-activation of the motor 23 as well as the operation of the air springs 34 and 55. The controller may be any known microprocessor or electrical control system that is capable of activating and de-activating the apparatus components in a pre-determined sequence and in response to signals from the sensors.

The dunnage sheet removal apparatus 10 is configured to mate with an existing conveyor system, and most particular for a conveyor system adapted for transporting unitized loads of sheet material. The length of the apparatus, and more particularly of the drive roller 22, is sized according to the width of the dunnage sheets being processed. In a typical installation, the drive roller is 96 inches wide to accept a standard dunnage sheet. The dunnage sheet may be of a variety of materials and thicknesses. The drive roller 22 and pinch rollers 25 may include a variety of outer surfaces that are adapted for gripping a sheet of paper or corrugated material. In one embodiment, the rollers have a rubber or tackified surface.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For instance, in the illustrated embodiment, the dunnage removal apparatus is situated at a right angle configuration between the load conveyor and the pre-feeder. In an alternative configuration, load can be transferred from a transfer car onto a reversing conveyor segment with the removal apparatus at the opposite end of the segment. The reversing conveyor then transfers the load and dunnage sheet to the mechanism where the dunnage sheet is removed, and then returns the load to the intake end of the conveyor segment where it is ready to be transferred to the pre-feeder.

It is also understood that the dunnage sheet removal apparatus may also be used to remove a dunnage sheet from between a load and a pallet carrying the load. With this variation, the positioning of the guide chute of the apparatus would be adjusted to account for the change in height of the dunnage sheet relative to the conveyor.

What is claimed is:

1. An apparatus for removing a dunnage sheet from a unitized load in which a flap of the dunnage sheet extends beyond a side of the unitized load, the apparatus comprising:

a guide chute having a mouth sized to receive the flap as the unitized load moves toward said guide chute, said guide chute configured to funnel said flap to a dunnage slot; and a sheet stripper mechanism arranged to receive the flap as it passes through said dunnage slot and operable to pull the flap away from the unitized load;

a support frame; and means for supporting said sheet stripper mechanism on said support frame to receive the dunnage sheet flap as it passes through said dunnage slot.

2. The apparatus of claim 1, wherein:

said sheet stripper mechanism includes:

a drive roller;

a motor coupled to rotate said drive roller; and at least one pinch roller arranged parallel to said drive roller to pinch the flap therebetween; and said means for supporting said sheet stripper mechanism supports said drive roller in a fixed position relative to said dunnage slot and supports said at least one pinch roller for movement relative to said drive roller.

3. The apparatus of claim 2, further comprising a backstop plate carried by said sheet stripper mechanism and arranged to contact the unitized load as said dunnage sheet is pulled away from the unitized load.

4. The apparatus of claim 3, wherein said means for supporting support said backstop plate for movement with said at least one pinch roller relative to said drive roller.

5. The apparatus of claim 2, wherein said means for supporting includes a pinch roller support assembly including:

a pair of guide slots defined on opposite side walls of said support frame;

a pair of side support plates, one each adjacent a corresponding one of said side walls, said side support plates rotatably supporting opposite ends of said at least one pinch roller; and a pair of guide flanges, one each attached to a corresponding one of said side support plates, each of said guide flanges configured for sliding engagement within a corresponding one of said pair of guide slots, whereby said at least one pinch roller is movable relative to said drive roller as said guide flanges slide within said guide slots.

6. The apparatus of claim 5, wherein said pinch roller support assembly further includes:

an elongated beam connected at its opposite ends to a corresponding one of said pair of side plates; and at least one air spring connecting said beam to said support frame, said air spring operable to move said elongated beam toward said drive roller.

7. The apparatus of claim 6, wherein said pinch roller support assembly further includes at least one lower resilient bushing connecting said beam to said support frame, said lower resilient bushing operable to resist movement of said elongated beam toward said drive roller.

8. The apparatus of claim 6, wherein said pinch roller support assembly further includes at least one power element connecting said beam to said support frame, said power element operable to move said elongated beam away said drive roller to thereby move said at least one pinch roller away from said drive roller to define a gap for receiving the flap of the dunnage sheet.

9. The apparatus of claim 6, further comprising a backstop plate adjustably supported by said beam and arranged to contact the unitized load as said dunnage sheet is pulled away from the unitized load.

10. An apparatus for removing a dunnage sheet from a unitized load in which a flap of the dunnage sheet extends beyond a side of the unitized load, the apparatus, further comprising:

a guide chute having a mouth sized to receive the flap as the unitized load moves toward said guide chute, said guide chute configured to funnel said flap to a dunnage slot;

a sheet stripper mechanism arranged to receive the flap as it passes through said dunnage slot and operable to pull the flap away from the unitized load; and a backstop plate carried by said sheet stripper mechanism and arranged to contact the unitized load as said dunnage sheet is pulled away from the unitized load.

* * * * *